US007202593B2

(12) United States Patent
Matsuoka et al.

(10) Patent No.: US 7,202,593 B2
(45) Date of Patent: Apr. 10, 2007

(54) STEEL SHEET FOR INNER MAGNETIC SHIELD AND METHOD OF PRODUCING THE SAME, INNER MAGNETIC SHIELD, AND COLOR CATHODE RAY TUBE

(75) Inventors: Hideki Matsuoka, Tokyo (JP); Reiko Sugihara, Tokyo (JP); Kenji Tahara, Tokyo (JP); Noriko Kubo, Kanagawa (JP); Keisuke Fukumizu, Tokyo (JP); Teruo Takeuchi, Tokyo (JP); Hiroaki Kato, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 356 days.

(21) Appl. No.: 10/476,403

(22) PCT Filed: Feb. 18, 2003

(86) PCT No.: PCT/JP03/01731

§ 371 (c)(1),
(2), (4) Date: Oct. 28, 2003

(87) PCT Pub. No.: WO03/070997

PCT Pub. Date: Aug. 28, 2003

(65) Prior Publication Data

US 2004/0129345 A1 Jul. 8, 2004

(30) Foreign Application Priority Data

Feb. 20, 2002 (JP) ..... 2002-042490

(51) Int. Cl.
*H01J 29/80* (2006.01)

(52) U.S. Cl. ..... 313/402; 313/479

(58) Field of Classification Search ..... 313/402, 313/407, 431, 433, 443, 479, 326
See application file for complete search history.

(56) References Cited

FOREIGN PATENT DOCUMENTS

| | | | |
|---|---|---|---|
| EP | 1 126 041 A | | 8/2001 |
| JP | 10-168551 A | | 6/1998 |
| JP | 2000-160252 A | | 6/2000 |
| JP | 2000-169945 A | | 6/2000 |
| JP | 2001-240946 A | | 9/2001 |
| JP | 2001-316768 A | | 11/2001 |
| JP | 2001-316777 A | | 11/2001 |
| JP | 2005060785 A | * | 3/2005 |
| WO | WO 01/12863 A | | 2/2001 |

OTHER PUBLICATIONS

I. Saitoh, "Magnetic Characteristics of Magnetic Shield in CRT and Their Effects on Landing Drifts Caused by Terrestrial Magnetic Field", Transaction of the Institute of Electronics, Information, and Engineers, vol. J79-C-II, No. 6, pp. 311-319 (Jun. 1996).

* cited by examiner

*Primary Examiner*—Vip Patel
(74) *Attorney, Agent, or Firm*—Frishauf, Holtz, Goodman & Chick, P.C.

(57) ABSTRACT

A steel sheet for an inner magnetic shield has a ratio of the anhysteretic magnetic permeability in the rolling direction to the anhysteretic magnetic permeability in the transversal direction, which is not higher than 0.7 or not lower than 1.4, preferably not higher than 0.5 or not lower than 2.0. A higher value of the two anhysteretic magnetic permeability values in the rolling direction and in the transversal direction is not lower than 18000. The inner magnetic shield formed of the particular steel sheet has a substantially truncated pyramid body which has a pair of short side members of a screen and a pair of long side members of a screen. The short side members are joined to the long side members at edge portions of the truncated pyramidal inner magnetic shield. The direction, in which the anhysteretic magnetic permeability of the steel sheet is the higher value, corresponds to the horizontal plane direction of the short side member. In addition, the direction, in which the anhysteretic magnetic permeability of the steel sheet is the higher value, corresponds to as required to the horizontal plane direction of the long side member.

15 Claims, 3 Drawing Sheets

STEEL SHEET FOR INNER MAGNETIC SHIELD AND METHOD OF PRODUCING THE SAME, INNER MAGNETIC SHIELD, AND COLOR CATHODE RAY TUBE

This application is a U.S. National Phase Application under 35 USC 371 of International Application PCT/JP03/01731 filed Feb. 18, 2003.

TECHNICAL FIELD

The present invention relates to a steel sheet used as a material of a magnetic shield member arranged inside a color cathode ray tube in a manner to cover the side region of the running electron beams, i.e., a steel sheet for the inner magnetic shield of a color cathode ray tube and a manufacturing method thereof, to an inner magnetic shield, and to a color cathode ray tube.

BACKGROUND ART

A color cathode ray tube comprises basically electron guns for emitting electron beams and a phosphor screen that emits light upon irradiation with the electron beams so as to form a visible image. The electron beams are deflected by the geomagnetism so as to generate a color drift in the visible image formed on the phosphor screen. For preventing the color drift, an inner magnetic shield, which is also called an inner shield, is arranged in the color cathode ray tube in general.

In recent years, commercial TV sets have been enlarged or widened in the screen size. As a result, the flight path length and the scanning length of the electron beams have been increased and, thus, the TV sets have become more susceptible to the effect of geomagnetism. In other words, a deviation of the landing point on the phosphor screen of the electron beam from the designated point, which is caused by the effect of geomagnetism (thus termed a geomagnetic drift), has become larger than before. At the same time, a finer screen has come to be handled because of the propagation of the hi-vision broadcasting and the initiation of the digital broadcasting, with the result that demands for reduction of the geomagnetic drift has becomes severer. On the other hand, since a finer still image is required in a color cathode ray tube for a personal computer, it is more necessary to suppress markedly the color drift caused by the geomagnetic drift.

Under the circumstances, it was customary in the past to evaluate in many cases the characteristics of the steel sheet used for preparation of the magnetic shields by using as indexes the magnetic permeability, the coercive force and the remanent flux density under a low magnetic field corresponding substantially to the geomagnetism.

A method of improving the characteristics of the steel sheet for magnetic shields is disclosed in, for example, Japanese Patent Disclosure (KOKAI) No. 10-168551. This prior art is directed to the technology for improving the magnetic characteristics by setting the ferrite crystal grain size of 3 to 20 μm of a steel having a specified composition. To be more specific, disclosed in this prior art are a magnetic shield material exhibiting a coercive force not smaller than 3 Oe and a remanent flux density not lower than 9 kG, which are the magnetic characteristics required for the cold rolled steel sheet used for preparation of magnetic shields, and a method of manufacturing the particular magnetic shield material.

In an article, Transaction (in Japanese) of the Institute of Electronics, Information, and Communication Engineers, vol. J79-C-II No. 6, pp. 311–319, June 1996, disclosed is the relationship between the anhysteretic magnetic permeability and the magnetic shielding effect required for improving the magnetic shielding effect.

It should be noted in this connection that the steel sheet for magnetic shields applied to the actual color cathode ray tube is demagnetized in general under the geomagnetism and, thus, the magnetic characteristics of the steel sheet are changed by the demagnetization under the geomagnetism. However, the particular change in the magnetic characteristics are not taken into account in the technology disclosed in Japanese Patent Disclosure No. 10-168551 pointed out above, leading to the problem that the magnetic shielding effect is insufficient.

The relationship between the anhysteretic magnetic permeability and the magnetic shielding effect is studied in the article, Transaction (in Japanese) of the Institute of Electronics, Information, and Communication Engineers, vol. J79-C-II No. 6, pp. 311–319, June 1996, pointed out above. However, the detailed studies as to what steel sheet exhibits a high anhysteretic magnetic permeability are not clarified in this article.

As pointed out above, the technology disclosed in each of the prior arts referred to above is incapable of sufficiently coping with the deterioration in the visible image formed on the phosphor screen, which is caused by the color drift accompanying the enlargement achieved in recent years in the phosphor screen of commercial TV sets. Also, the color drift problem has not yet been resolved in respect of the cathode ray tube for personal computers.

Under the circumstances, strongly required nowadays is a high performance steel sheet for magnetic shields having a magnetic shielding effect.

DISCLOSURE OF THE INVENTION

An object of the present invention is to provide a steel sheet for inner magnetic shields excellent in the shielding effect from geomagnetism, which is capable of decreasing the geomagnetic drift amount, and a method of manufacturing the particular steel sheet, to provide inner magnetic shields, and to provide a color cathode ray tube.

According to a first aspect of the present invention, there is provided a steel sheet for inner magnetic shields excellent in a shielding effect from geomagnetism, wherein a ratio of an anhysteretic magnetic permeability of the steel sheet in a rolling direction to an anhysteretic magnetic permeability of the steel sheet in a transversal direction is not higher than 0.7 or not lower than 1.4, and a higher value of the two anhysteretic magnetic permeability values in the rolling direction and in the transversal direction is not lower than 18000.

According to a second aspect of the present invention, there is provided a steel sheet for inner magnetic shields excellent in a shielding effect from geomagnetism, wherein a ratio of an anhysteretic magnetic permeability of the steel sheet in a rolling direction to an anhysteretic magnetic permeability of the steel sheet in a transversal direction is not higher than 0.5 or not lower than 2.0, and a higher value of the two anhysteretic magnetic permeability values in the rolling direction and in the transversal direction is not lower than 18000.

According to a third aspect of the present invention, there is provided a method of manufacturing a steel sheet for inner magnetic shields excellent in a shielding effect from geomagnetism, comprising the steps of:

hot rolling a steel slab consisting essentially of higher than 0.005% and not higher than 0.06% by weight of C, lower than 0.3% by weight of Si, not higher than 1.5% by weight of Mn, not higher than 0.05% by weight of P, not higher than 0.04% by weight of S, not higher than 0.1% by weight of Sol. Al, and the balance of Fe:

cold rolling the resultant hot rolled steel band;

continuously annealing the resultant cold rolled steel band at temperatures of 600° C. to 780° C. under a line tension not lower than 9.8 $N/mm^2$; and tempering rolling the annealed steel sheet as required at an elongation rate not higher than 0.2%.

According to a fourth aspect of the present invention, there is provided an inner magnetic shield excellent in a shielding effect from geomagnetism used in a color cathode ray tube, the inner magnetic shield having a substantially truncated pyramidal body which has a pair of short side members of a screen and a pair of long side members of a screen, and constructed such that the short side members are joined to the long side members at edge portions of the substantially truncated pyramidal magnetic shield, wherein:

the inner magnetic shield is made of a steel sheet, a ratio of an anhysteretic magnetic permeability of the steel sheet in a rolling direction to an anhysteretic magnetic permeability of the steel sheet in a transversal direction being not higher than 0.5 or not lower than 2.0, and a higher value of the two anhysteretic magnetic permeability values in the rolling direction and in the transversal direction being not lower than 18000; and the direction, in which the anhysteretic magnetic permeability of the steel sheet is the higher value, corresponds to the horizontal plane direction of the short side member.

According to a fifth aspect of the present invention, there is provided an inner magnetic shield excellent in the shielding effect from geomagnetism used in a color cathode ray tube, the inner magnetic shield having a substantially truncated pyramidal body which has a pair of short side members of a screen and a pair of long side members of a screen, and constructed such that the short side members are joined to the long side members at edge portions of the substantially truncated pyramidal magnetic shield, wherein:

the inner magnetic shield is made of a steel sheet, a ratio of an anhysteretic magnetic permeability of the steel sheet in a rolling direction to an anhysteretic magnetic permeability of the steel sheet in a transversal direction being not higher than 0.7 or not lower than 1.4, and a higher value of the two anhysteretic magnetic permeability values in the rolling direction and in the transversal direction being not lower than 18000, or a ratio of an anhysteretic magnetic permeability of the steel sheet in a rolling direction to an anhysteretic magnetic permeability of the steel sheet in a transversal direction being not higher than 0.5 or not lower than 2.0, and a higher value of the two anhysteretic magnetic permeability values in the rolling direction and in the transversal direction being not lower than 18000; and the direction, in which the anhysteretic magnetic permeability of the steel sheet is the higher value, corresponds to the horizontal plane direction of the short side member and to the horizontal plane direction of the long side member.

In the inner magnetic shield according to the fourth or fifth aspect of the present invention, it is desirable for the long side member of a screen and/or the short side member of a screen to include a V-shaped notch, or it is desirable for the long side member of a screen and/or the short side member of a screen to include a slit.

According to a sixth aspect of the present invention, there is provided a color cathode ray tube, comprising an inner magnetic shield, wherein:

the inner magnetic shield has a substantially truncated pyramidal body having a pair of short side members of a screen and a pair of long side members of a screen, and constructed such that the short side members are joined to the long side members at edge portions of the substantially truncated pyramidal magnetic shield;

the inner magnetic shield is made of a steel sheet, a ratio of an anhysteretic magnetic permeability of the steel sheet in a rolling direction to an anhysteretic magnetic permeability of the steel sheet in a transversal direction being not higher than 0.5 or not lower than 2.0, and a higher value of the two anhysteretic magnetic permeability values in the rolling direction and in the transversal direction being not lower than 18000; and the direction, in which the anhysteretic magnetic permeability of the steel sheet is the higher value, corresponds to the horizontal plane direction of the short side member.

Further, according to a seventh embodiment of the present invention, there is provided a color cathode ray tube comprising an inner magnetic shield, wherein:

the inner magnetic shield has a substantially truncated pyramidal body having a pair of short side members of a screen and a pair of long side members of a screen, and constructed such that the short side members are joined to the long side members at edge portions of the substantially truncated pyramidal magnetic shield;

the inner magnetic shield is made of a steel sheet, a ratio of an anhysteretic magnetic permeability of the steel sheet in a rolling direction to an anhysteretic magnetic permeability of the steel sheet in a transversal direction being not higher than 0.7 or not lower than 1.4, and a higher value of the two anhysteretic magnetic permeability values in the rolling direction and in the transversal direction being not lower than 18000, or a ratio of an anhysteretic magnetic permeability of the steel sheet in the rolling direction to an anhysteretic magnetic permeability of the steel sheet in a transversal direction being not higher than 0.5 or not lower than 2.0, and a higher value of the two anhysteretic magnetic permeability values in the rolling direction and in the transversal direction being not lower than 18000; and the direction, in which the anhysteretic magnetic permeability of the steel sheet is the higher value, corresponds to the horizontal plane direction of the long side member and to the horizontal plane direction of the short side member.

BEST MODE FOR WORKING THE INVENTION

Figure 1:
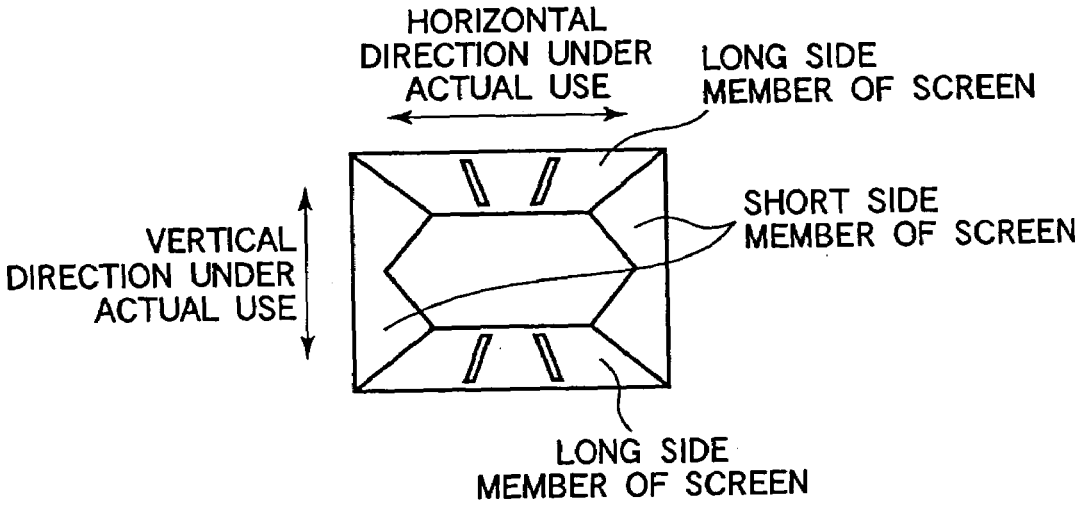
FIG. 1 is schematic view showing the construction of a substantially truncated pyramidal inner magnetic shield for a color cathode ray tube, wherein the side members thereof are joined to each other at the edge portions of the inner shield.

The present invention will now be described in detail.

In general, in a color cathode ray tube, demagnetization is carried out by applying an alternating current to a demagnetizing coil wound outside the cathode ray tube when the TV set is switched on or in other opportunities in order to adjust the effect of the external magnetic field to a constant condition under the operating circumstance. In this method, since the magnetic shield inside the cathode ray tube is demagnetized within the geomagnetism, the magnetic shields can remain more highly magnetized than those firstly perfectly demagnetized followed by magnetization by a magnetic field corresponding to the geomagnetism. The present inventors have paid attentions to the particular phenomenon and filed previously an international patent application (PCT/JP00/05374) in respect of a steel sheet for magnetic shields, with attentions paid to the anhysteretic magnetic permeability, which can be used as an appropriate evaluation index of the magnetic characteristics in this case.

As a result of a continued research made in an attempt to further improve the shielding effect from geomagnetism, the present inventors have found that:

(a) Where the anhysteretic magnetic permeability of the steel sheet for the inner magnetic shield in the rolling direction widely differs from that in a transversal direction which is a direction perpendicular to the rolling direction, i.e., where a ratio of the anhysteretic magnetic permeability noted above is not higher than 0.7 (more preferably not higher than 0.5) or not lower than 1.4 (more preferably not lower than 2.0), and a higher value of the two anhysteretic magnetic permeability values in the rolling direction and in the transversal direction is not lower than 18000, the magnetic shielding effect can be enhanced so as to suppress the geomagnetic drift;

(b) Where the inner magnetic shield member has a substantially truncated pyramidal body in which the side members thereof are joined to each other at the edge portions of the magnetic shield member, the shielding effect from geomagnetism can be improved if a steel sheet having the ratio of the anhysteretic magnetic permeability noted above, which is not higher than 0.5 or not lower than 2.0, is used for forming the magnetic shield and if the direction, in which the anhysteretic magnetic permeability of the steel sheet is the higher value of the two anhysteretic magnetic permeability, corresponds to the horizontal plane direction of the short side member; and (c) If the direction, in which the anhysteretic magnetic permeability of the steel sheet is a higher value, corresponds to the horizontal plane direction of the long side member as well as the short side member, it is possible to further improve the shielding effect from geomagnetism so as to permit obtaining the shielding effect from geomagnetism higher than that in the prior art, even in the case of using a steel sheet having a ratio of the anhysteretic magnetic permeability noted above, which is not higher than 0.7 or not lower than 1.4.

The present inventors have achieved the present invention based on the finding described above.

In the steel sheet for magnetic shields according to the present invention, a ratio of the anhysteretic magnetic permeability in the rolling direction to that in the transversal direction is not higher than 0.7 or not lower than 1.4, and a higher value of the two anhysteretic magnetic permeability values is not lower than 18000. Preferably, a ratio of the anhysteretic magnetic permeability in the rolling direction to that in the transversal direction is not higher than 0.5 or not lower than 2.0.

It is possible to enhance the magnetic shielding effect by increasing the anisotropy in the anhysteretic magnetic permeability of the steel sheet with respect to the rolling direction of the steel sheet and the transversal direction and by setting the higher value of the two anhysteretic magnetic permeability values in the rolling direction and in the transversal direction at a value not lower than 18000.

In the present invention, the composition of the steel sheet used for preparing the inner magnetic shield is not particularly limited as far as the requirements described above are satisfied. It is preferable that the steel sheet consists essentially of higher than 0.005% and not higher than 0.06% by weight of C, lower than 0.3% by weight of Si, not higher than 1.5% by weight of Mn, not higher than 0.05% by weight of P, not higher than 0.04% by weight of S, not higher than 0.1% by weight of Sol. Al, and the balance of Fe. Each of the components of the steel sheet will now be described.

C: Carbon (C) is an element important for enhancing the anhysteretic magnetic permeability of the steel sheet and for increasing the anisotropy of the anhysteretic magnetic permeability of the steel sheet with respect to the rolling direction and the transversal direction. It is desirable for the C content of the steel sheet to exceed 0.005% by weight. It should be noted, however, that, if C is contained in the steel in an excessively large amount, carbide is precipitated in the steel sheet so as to increase the coercive force of the steel sheet, with the result that it is difficult to carry out a demagnetization sufficient for ensuring a high anhysteretic magnetic permeability. Such being the situation, it is desirable for the C content of the steel sheet not to exceed 0.06% by weight.

Si: Silicon (Si) tends to be concentrated on the surface of the steel sheet during the annealing process, thereby deteriorating the adhesion properties of the plating layer or the adhesion properties of a coating formed in the blackening treatment. Therefore, it is desirable for the Si content of the steel sheet to be lower than 0.3% by weight, more desirably not higher than 0.1% by weight.

Mn: Manganese (Mn) is an element effective for enhancing the anisotropy in the anhysteretic magnetic permeability of the steel sheet with respect to the rolling direction and the transversal direction. If Mn is added in an excessively large amount, however, the manufacturing cost of the steel sheet is increased. Therefore, it is desirable for the Mn content of the steel sheet to be not higher than 1.5% by weight.

P: Phosphorus (P) is an element effective for increasing the mechanical strength of the steel sheet so as to improve the handling properties of the steel sheet. If the P addition amount is excessively large, however, its segregation may result in cracking during the production of the steel sheet. Such being the situation, it is desirable for the P content of the steel sheet to be not higher than 0.05% by weight.

S: S content is preferably as small as possible for keeping the vacuum well in the color cathode ray tube. To be more specific, it is desirable for the S content of the steel sheet to be not higher than 0.04% by weight.

Sol. Al: Aluminum (Al) is an essential element for the deoxidation reaction in the steelmaking process. However, if its amount is too high, inclusions may increase. Such being the situation, it is desirable to add Al to the steel sheet in an amount not higher than 0.1% by weight in the form of sol. Al.

It is also possible to add boron (B) in an amount falling within a range of between 0.0003 and 0.01% by weight. The B addition is further effective for increasing the anhysteretic magnetic permeability of the steel sheet. Further, it is desirable to suppress the nitrogen (N) content of the steel sheet. If N is contained in an excessively large amount, defects tend to be generated on the surface of the steel sheet. Therefore, it is desirable for the N content of the steel sheet to be not higher than 0.01% by weight.

The manufacturing conditions of the steel will now be described.

First, a steel having above-mentioned composition is smelted and then subjected to a continuous casting so as to obtain a steel slab, followed by hot rolling the steel slab. The continuously-cast slab may be hot rolled directly or after slightly heating the slab. Alternatively, the continuously-cast slab may be hot rolled after cooled and then re-heated. It is desirable for the heating temperature in the case of employing the reheating to fall within a range of between 1050° C. and 1300° C. If the heating temperature is lower than 1050° C., it is difficult to set the finish temperature in the hot rolling step at a level not lower than the $Ar_3$ transformation temperature. On the other hand, it is undesirable for the heating temperature to exceed 1300° C. because the amount of the oxides formed on the slab surface is increased. In order to make uniform the grain size after the hot rolling, the finish temperature in the hot rolling step should be set at a level not lower than the $Ar_3$ transformation temperature. On the other hand, the coiling temperature should be not higher than 700° C. It is undesirable for the coiling temperature to exceed 700° C. because, if the coiling temperature exceeds 700° C., film-like $Fe_3C$ may precipitate along the grain boundaries of the hot rolled steel sheet so as to deteriorating the uniformity.

The hot-rolled steel sheet is pickled and, then, cold rolled at a rolling reduction falling within, desirably, a range of between 70% and 94%. It is undesirable for the rolling reduction to be lower than 70% because, if the rolling reduction is lower than 70%, the grain size of the annealed steel sheet is rendered coarse so as to cause the steel sheet to be unfavorably softened. Also, if the rolling reduction in the cold rolling exceeds 94%, the anhysteretic magnetic permeability of the steel sheet tends to be deteriorated.

It should be noted that, if the steel sheet is excessively thin, the magnetic shield prepared by using the steel sheet fails to produce a sufficiently high magnetic shielding effect even if the steel sheet exhibits a high anhysteretic magnetic permeability. Also, the steel sheet fails to exhibit a rigidity required for the part of the magnetic shield. Such being the situation, it is desirable for the steel sheet to have a thickness not smaller than 0.05 mm. In order to enhance the magnetic shielding effect, it is desirable to increase the thickness of the steel sheet. However, it is desirable for the TV set to be lightweight in accordance with the recent trend toward the enlargement in the phosphor screen of the color cathode ray tube. Such being the situation, it is desirable for the thickness of the steel sheet to be not larger than 0.5 mm.

In the next step, a continuous annealing is carried out in order to re-crystallize the cold-rolled steel sheet. In the present invention, the continuous annealing temperature is set to fall within a range of between 600° C. and 780° C. It is undesirable for the annealing temperature to be lower than 600° C. because, if the annealing temperature is lower than 600° C., the recrystallization fails to be finished completely, with the result that deformation strain due to cold-rolling may remain. Also, it is undesirable for the annealing temperature to be excessively high because, if the annealing temperature is excessively high, the anhysteretic magnetic permeability of the steel sheet is deteriorated. Such being the situation, the upper limit of the annealing temperature should be set at 780° C. It is more desirable for the annealing to be carried out in a ferrite single phase region or under a temperature region not higher than the $Ac_1$ transformation temperature. Also, in the present invention, the line tension in the continuous annealing step is set at 9.8 N/mm$^2$ or more. In order to increase the anisotropy in the anhysteretic magnetic permeability of the steel sheet, it is effective to set the line tension to fall within the range noted above.

Table 1 shows the anhysteretic magnetic permeability in the rolling direction of the steel sheet, with the case where the tension is zero used as the criterion, covering the case where a cold rolled steel sheet having the composition equal to that of steel C included in the Example described in the following and having a thickness of 0.3 mm was annealed at 650° C. for 60 seconds with the tension set to fall within a range of between 0 and 19.6 N/mm$^2$. As apparent from Table 1, the anhysteretic magnetic permeability of the steel sheet in the rolling direction is increased by 10% or more in the case where the tension in the annealing step is set at 9.8 N/mm$^2$ or more. It is found that this is effective in increasing the anisotropy of the anhysteretic permeability (the ratio of the anhysteretic magnetic permeability of the steel sheet in the rolling direction to that in the transversal direction).

TABLE 1

| Annealing Tension (N/mm$^2$) | Rate of Change in Anhysteretic Magnetic Permeability in Rolling Direction (Relative Value with the Value for the case of Tension O N/mm$^2$ set at 1) |
|---|---|
| 0.0 | 1.00 |
| 4.9 | 1.05 |
| 9.8 | 1.11 |
| 19.6 | 1.22 |

Incidentally, the region of the continuous annealing line where the particular tension is imparted to the steel sheet is not limited to the so-called "soaking zone". Even if the tension is imparted to the steel sheet in the temperature elevating process called a heating zone, the effect of increasing the anisotropy in the anhysteretic magnetic permeability can be exhibited if the line tension noted above is kept imparted to the steel sheet for more than several seconds at the temperature region of 400 to 450° C. or higher at which the restoring phenomenon is started.

After the annealing, it is most desirable not to apply a temper rolling. Even where a temper rolling is applied, it is necessary for the elongation rate to be as low as possible, e.g., to be set at 0.2% or less. The present inventors have looked into the effect given by the elongation rate in the temper rolling to the anisotropy in the anhysteretic magnetic permeability of the steel sheet. It has been found that, where a temper rolling is conducted, the anhysteretic magnetic permeability of the steel sheet in the rolling direction is markedly lowered. On the other hand, the anhysteretic magnetic permeability is scarcely decreased in the transversal direction, or even if decreased, the degree of decrease is markedly lower than that of the anhysteretic magnetic permeability in the rolling direction. Since the anhysteretic magnetic permeability in the rolling direction of the steel sheet as annealed is higher in general than that in the transversal direction, the finding referred to above supports that the anisotropy of the anhysteretic magnetic permeability is diminished by the temper rolling.

Table 2 shows the anhysteretic magnetic permeability in the rolling direction and in the transversal direction, and the ratio of the anhysteretic magnetic permeability in the rolling direction to that in the transversal direction in respect of the steel sheet to which a temper rolling was not applied (Sample No. 1) and the steel sheets to which a temper rolling was applied under an elongation rate of 0.2 to 1.5% (Samples Nos. 2 to 6). As apparent from Table 2, the ratio of the anhysteretic magnetic permeability is rendered lower than 1.4 in the case of applying a temper rolling under an elongation rate exceeding 0.2%.

TABLE 2

| No. | Elongation Rate of Temper Rolling (%) | Anhysteretic Magnetic Permeability Rolling Direction ① | Anhysteretic Magnetic Permeability Transversal Direction ② | Rate of Anhysteretic Magnetic Permeability (①/②) |
|---|---|---|---|---|
| 1 | 0.0 | 20000 | 8800 | 2.27 |
| 2 | 0.2 | 13500 | 8700 | 1.55 |
| 3 | 0.3 | 11500 | 8700 | 1.32 |
| 4 | 0.5 | 9000 | 8700 | 1.03 |
| 5 | 1.0 | 6800 | 8800 | 0.77 |
| 6 | 1.5 | 6800 | 8800 | 0.77 |

In general, a temper rolling is applied to the steel sheet used for the processing in an attempt to prevent a surface defect called a stretcher strain mark after the processing. In the case of the inner magnetic shield, however, the forming and processing are originally not severe and, thus, a marked surface defect is not generated even if a temper rolling is not applied. It follows that it is most desirable not to apply a temper rolling in view of the aspect of increasing the anisotropy of the anhysteretic magnetic permeability. Even if the temper rolling is applied, it is necessary to set the elongation rate in the temper rolling treatment at 0.2% or less.

The manufacturing conditions described above are no more than examples. The manufacturing conditions are not limited to the examples described above as far as it is possible to obtain the steel sheet of the present invention.

It is possible to apply, as required, a Cr plating and/or a Ni plating on the steel sheet for the inner magnetic shield of the present invention. The plating is desirable in view of, for example, the rust prevention in particularly the case where the blackening heat treatment is omitted. It is possible for the plating layer to be of a single layer structure or of a laminate structure. Also, it is possible to form the plating layer on one surface or both surfaces of the steel sheet. The formation of the plating is effective for preventing the rusting of the steel sheet as described above. In addition, the plating is effective for suppressing the gas generation from the steel sheet when the inner magnetic shield formed of the steel sheet is incorporated in the cathode ray tube. It is unnecessary to define particularly the coverage of the plating material. It suffices to select appropriately the coverage that permits substantially covering the surface of the steel sheet. It is also possible to apply a Ni plating partially or to the entire surface, followed by applying a chromate treatment so as to cover the surface of the steel sheet.

The direction of the steel sheet in the inner magnetic shield, which is most important in the present invention, will now be described.

In the prior art, the shielding effect from geomagnetism was not taken into account in respect of each member of the inner magnetic shield incorporated in the color cathode ray tube, and a so-called "blank layout" was applied in the direction in which the blank loss can be minimized, in the direction adapted for the mass production, or in both of these directions in accordance with the kind of the color cathode ray tube.

On the other hand, in the present invention, a steel sheet having a large anisotropy in the anhysteretic magnetic permeability as described above is used in an inner magnetic shield for a color cathode ray tube having a substantially truncated pyramidal body shown in FIG. 1, which has a pair of short side members of a screen and a pair of long side members of a screen, and constructed such that the short side members are joined to the long side members at the edge portions of the substantially truncated pyramidal magnetic shield. It is important to note that the direction, in which the anhysteretic magnetic permeability of the steel sheet is the higher value, corresponds to the horizontal plane direction of the short side members (right and left side members in the drawing). The shielding effect from geomagnetism can be further improved, if the direction, in which the anhysteretic magnetic permeability of the steel sheet is the higher value, corresponds to the horizontal plane direction of the long side members (upper and lower members in the drawing), too.

Where the anisotropy in the anhysteretic magnetic permeability of the steel sheet is not higher than 0.5 or not lower than 2.0, and a higher value of the two anhysteretic magnetic permeability values in the rolling direction and in the transversal direction is not lower than 18000, the shielding effect from geomagnetism can be improved if the direction, in which the anhysteretic magnetic permeability of the steel sheet is the higher value, corresponds to the horizontal plane direction of at least the short side member. In addition, if the direction, in which the anhysteretic magnetic permeability of the steel sheet is the higher value, corresponds to the horizontal plane direction of the long side member as well as the short side member, the shielding effect from geomagnetism can be further improved. Also, where the anisotropy in the anhysteretic magnetic permeability of the steel sheet is higher than 0.5 and not higher than 0.7, or not lower than 1.4 and lower than 2.0, the effect of improving the shielding effect from geomagnetism can be ensured if the direction, in which the anhysteretic magnetic permeability of the steel sheet is the higher value, corresponds to the horizontal plane direction of each of the short side member and the long side member.

The mechanism described above has not necessarily been clarified sufficiently at this stage. However, it is considered reasonable to understand, in the case of the magnetic shield in which the material having a large anisotropy in the anhysteretic magnetic permeability is arranged as described above, the balance of the magnetic shielding effects relative to the external magnetic fields in various directions such as the tube axial direction, the screen horizontal direction and the vertical direction is rendered appropriate.

Incidentally, in the present invention, it is possible to form a V-shaped notch and/or a slit in the short side member and the long side member in order to control the balance of the shielding effects from geomagnetism in various sites on the screen. By forming the V-shaped notch and/or the slit as noted above, it is possible to ensure the balance of the geometric drift amounts over the entire screen.

Figure 2:
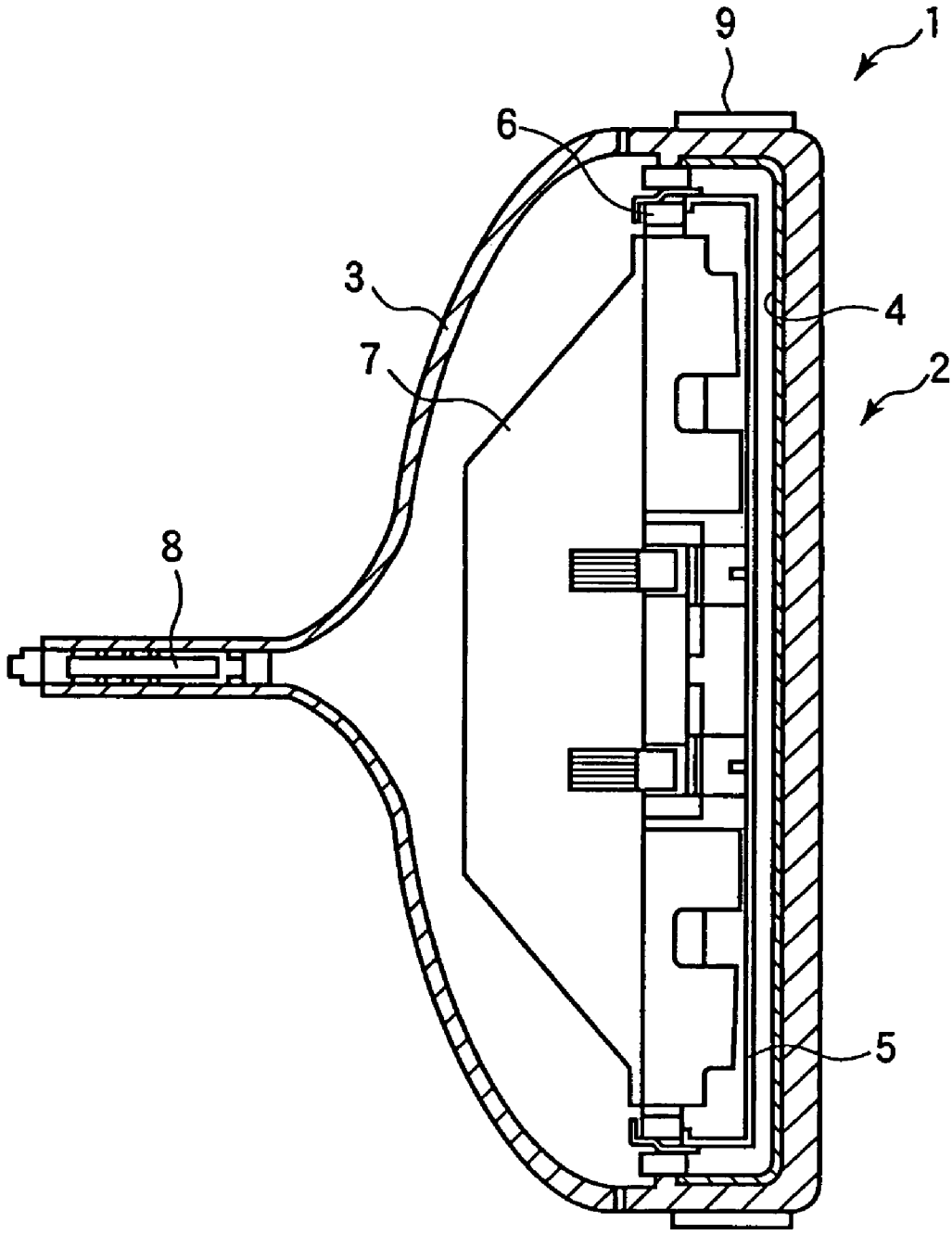
FIG. 2 is a cross sectional view showing the construction of a cathode ray tube comprising the inner magnetic shield of the present invention.

FIG. 2 is a cross sectional view schematically showing the construction of a color cathode ray tube equipped with the inner magnetic shield of the present invention. As shown in the drawing, a cathode ray tube 1 comprises a panel portion 2 for displaying an image and a funnel portion 3. The panel portion 2 is welded to the funnel portion 3 so as to maintain a high degree of vacuum inside the cathode ray tube 1. A phosphor screen 4 coated with red, green and blue phosphors is arranged inside the panel portion 2, and a tension mask is arranged to face the phosphor screen 4. The tension mask 5 is stretched by using a frame 6, and a color selecting electrode is formed by these tension mask 5 and frame 6. Further, an inner magnetic shield 7 of the present invention is arranged on the back side of the frame 6. Incidentally, a reference numeral 8 shown in the drawing denotes electron guns, and a reference numeral 9 denotes a heat shrink band.

EXAMPLE

Each of ingot steels A, B, and C shown in Table 3 was smelted, heated to 1200 to 1250° C., and hot rolled at a finish temperature of 870 to 890° C. and a coiling temperature of 620° C., thereby obtaining a hot rolled steel sheet having a thickness of 2.3 mm. The hot rolled steel sheet thus obtained was pickled and, then, cold rolled so as to obtain a cold rolled steel sheet having a thickness of 0.3 mm. Further, the cold rolled steel sheet was annealed for 90 seconds under a tension of 9.8 N/mm$^2$ at 800° C. for steel A and at 630° C. for each of steels B and C. Then, a temper rolling was applied to steel A corresponding to the conventional steel under an elongation rate of 1%. Incidentally, the temper rolling was not applied to each of steels B and C. Also, steels B and C fell within the preferred range of the steel composition, and steel A failed to fall within the preferred range of the steel composition.

TABLE 3

| Steel | C | Si | Mn | P | S | sol.Al | N | Nb | B |
|---|---|---|---|---|---|---|---|---|---|
| A | 0.0022 | 0.01 | 0.14 | 0.008 | 0.008 | 0.038 | 0.0024 | 0.026 | — |
| B | 0.049 | 0.01 | 0.38 | 0.016 | 0.014 | 0.046 | 0.0028 | — | — |
| C | 0.020 | 0.01 | 0.12 | 0.008 | 0.011 | 0.013 | 0.0020 | — | 0.0013 |

(by weight %)

Strip specimens each having a width of 10 mm and a length of 100 mm, the longitudinal direction of each strip specimen providing the rolling direction and the transversal direction, were cut from each of the steels thus prepared. These strip specimens for each steel were piled crosswise in two parallels so as to form a closed magnetic circuit, and the anhysteretic magnetic permeability was measured by the procedure given below.

Measuring Method of Anhysteretic Magnetic Permeability

1) An attenuating AC current is allowed to flow through a magnetization coil so as to demagnetize completely the strip specimen.

2) An attenuating AC current is allowed to flow again through the magnetization coil under the state that a DC current is allowed to flow through a DC-bias-field coil so as to generate a DC bias magnetic field of 0.35 Oe, thereby demagnetizing the strip specimen.

3) Current is allowed to flow again through the magnetization coil so as to excite the strip specimen, and the generated magnetic flux is detected by a search coil so as to measure a B-H curve.

4) The anhysteretic magnetic permeability is calculated from the B-H curve thus measured.

Table 4 shows the results of the measurement. As apparent from Table 4, the steel sheet prepared by the procedure described above by using steel sample A, i.e., steel sheet sample No. 1 for the inner magnetic shield, is a steel sheet as a comparative example failing to fall within the range specified in the present invention in respect of each of the ratio of the anhysteretic magnetic permeability in the rolling direction to that in the transversal direction and the value of one of the two values, which is higher than the other, of the anhysteretic magnetic permeability in the rolling direction and the anhysteretic magnetic permeability in the transversal direction. On the other hand, each of the steel sheets prepared by the procedure described above by using steels B and C, i.e., steel sheet samples Nos. 2 to 9 for the inner magnetic shield, is a steel sheet of the present invention satisfying any of the two requirements described above.

Next, the strip specimens (steel sheet samples) described above were processed into inner magnetic shield samples Nos. 1 to 9 each having a prescribed shape, in which the direction, in which the anhysteretic magnetic permeability of each of the short side member and the long side member was a higher value, was changed as shown in Table 4. Each of the inner magnetic shield samples thus prepared was mounted to a TV color cathode ray tube of 29 inches for evaluating the geomagnetic drift preventing effect. The color cathode ray tubes used were the same in respect of the constituting members other than the inner magnetic shield and the manufacturing method thereof.

The geomagnetic drift preventing effect was evaluated by measuring the drifting amount in the landing point of the electron beam caused by the geomagnetism. To be more specific, a color cathode ray tube (CRT) was rotated by 360° under the state that a vertical magnetic field of 0.35 Oe and a horizontal magnetic field of 0.30 Oe were applied to the CRT so as to measure the positional deviation (landing error) in the landing point of the electron beam relative to the reference point, and the value between the peak-to-peak value of the landing error was obtained as the horizontal drifting amount Bh. Incidentally, the horizontal drifting amount Bh at the screen corner portion shown in Table 4, which denotes the drifting amount of the landing error, is indicated by a relative value based on the value of 1 for the inner magnetic shield sample No. 1 using the steel A. The drifting amount of the landing error for the conventional magnetic shield is about 1 to 1.1.

Figure 3:
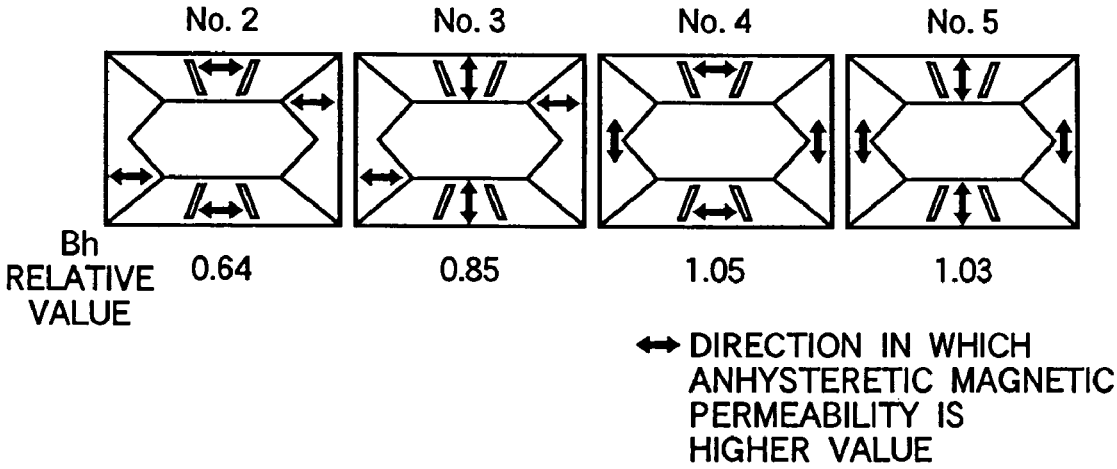
FIG. 3 shows the method of arranging the short side members and the long side members of the inner magnetic shield and the geomagnetism drifting amount in respect of four kinds of combinations differing from each other in the direction, in which the anhysteretic magnetic permeability of the steel sheet is higher value.

FIG. 3 shows the method of arranging the short side members and the long side members and the drifting amount due to geomagnetism in respect of four kinds of combinations (which correspond to inner magnetic shield samples Nos. 2 to 5) differing from each other in the direction, in which the anhysteretic magnetic permeability of the steel sheet was the higher value.

TABLE 4

| No. | Steel | Anhysteretic Magnetic Permeability: Rolling Direction ① | Anhysteretic Magnetic Permeability: Transversal Direction ② | Rate of Anhysteretic Magnetic Permeability (① /② ) | Direction having Higher Value in Anhysteretic Magnetic Permeability: Short Side Member of Screen | Direction having Higher Value in Anhysteretic Magnetic Permeability: Long Side Member of Screen | Bh at Screen Corner Portion (Relative Value based on the Value for No. 1) |
|---|---|---|---|---|---|---|---|
| 1 | A | 4100 | 9900 | 0.41 | Horizontal | Vertical | 1.00 |
| 2 | B | 25000 | 9600 | 2.60 | Horizontal | Horizontal | 0.64 |
| 3 | B | 25000 | 9600 | 2.60 | Horizontal | Vertical | 0.85 |
| 4 | B | 25000 | 9600 | 2.60 | Vertical | Horizontal | 1.05 |
| 5 | B | 25000 | 9600 | 2.60 | Vertical | Vertical | 1.03 |
| 6 | C | 19600 | 13300 | 1.47 | Horizontal | Horizontal | 0.67 |
| 7 | C | 19600 | 13300 | 1.47 | Horizontal | Vertical | 1.10 |
| 8 | C | 19600 | 13300 | 1.47 | Vertical | Horizontal | 1.08 |
| 9 | C | 19600 | 13300 | 1.47 | Vertical | Vertical | 1.03 |

Each of the inner magnetic shield samples Nos. 2 to 9 shown in Table 4 was formed of a steel sheet satisfying the requirement of the present invention in respect of the anhysteretic magnetic permeability. Particularly, as apparent from Table 4 and FIG. 3, each of the inner magnetic shield samples Nos. 2, 3 and 6 satisfied the requirements specified in the present invention in respect of the magnetic characteristics of the raw material steel sheet and the arrangement the direction, in which the anhysteretic magnetic permeability of the steel sheet is the higher value. It was confirmed that each of the inner magnetic shield samples Nos. 2, 3 and 6 was superior in the geomagnetic drift suppressing effect to the inner magnetic shield sample No. 1 failing to satisfy the requirement of the present invention in respect of the anhysteretic magnetic permeability of the raw material steel sheet. Particularly, a prominently high effect of suppressing the geomagnetic drift was confirmed in inner magnetic shield samples Nos. 2 and 6 in which the direction, in which the anhysteretic magnetic permeability of the steel sheet is the high value, corresponds to the horizontal direction of not only the short side members but also the long side members. Incidentally, these inner magnetic shield samples 2, 3 and 6 were found to be substantially equal to the conventional inner magnetic shield in the drifting amount relative to the magnetic field in the vertical direction.

On the other hand, inner magnetic shield samples Nos. 4, 5, 7, 8 and 9 failed to satisfy the requirements of the present invention in respect of the arrangement of the direction, in which the anhysteretic magnetic permeability is the higher value. In each of these samples, the effect of suppressing the geomagnetic drift was not recognized so as to make it necessary to employ troublesome steps as a measure against the color drift.

As described above, the magnetic shielding effect can be enhanced in the present invention by increasing the anisotropy in the anhysteretic magnetic permeability of the steel sheet with respect to the rolling direction of the steel sheet and the transversal direction and by setting the higher value of the two anhysteretic magnetic permeability values in the rolling direction and in the transversal direction at 18000 or more. In addition, a higher magnetic shielding effect can be obtained by being corresponded the direction, in which the anhysteretic magnetic permeability of the steel sheet is the higher value, to the horizontal plane direction of the short side member. Further, a more improved magnetic shielding effect can be obtained by being corresponded the direction, in which the anhysteretic magnetic permeability of the steel sheet is the higher value, to the horizontal plane direction of the long side member as well as the short side member. It follows that the present invention makes it possible to suppress the color deviation in the color cathode ray tube caused by the geomagnetic drift.

What is claimed is:

1. A color cathode ray tube, comprising an inner magnetic shield, wherein:

the inner magnetic shield has a substantially truncated pyramidal body having a pair of short side members of a screen and a pair of long side members of a screen, and constructed such that said short side members are joined to said long side members at edge portions of the substantially truncated pyramidal magnetic shield;

the inner magnetic shield is made of a steel sheet, a ratio of an anhysteretic magnetic permeability of the steel sheet in a rolling direction to an anhysteretic magnetic permeability of the steel sheet in a transversal direction being not higher than 0.5 or not lower than 2.0, and a higher value of the two anhysteretic magnetic permeability values in the rolling direction and in the transversal direction being not lower than 18000; and the direction, in which the anhysteretic magnetic permeability of the steel sheet is said higher value, corresponds to the horizontal plane direction of said short side member.

2. A color cathode ray tube comprising an inner magnetic shield, wherein:

the inner magnetic shield has a substantially truncated pyramidal body having a pair of short side members of a screen and a pair of long side members of a screen, and constructed such that said short side members are joined to said long side members at edge portions of the substantially truncated pyramidal magnetic shield;

the inner magnetic shield is made of a steel sheet, a ratio of an anhysteretic magnetic permeability of the steel sheet in a rolling direction to an anhysteretic magnetic permeability of the steel sheet in a transversal direction being not higher than 0.7 or not lower than 1.4, and a higher value of the two anhysteretic magnetic permeability values in the rolling direction and in the transversal direction being not lower than 18000, or a ratio of an anhysteretic magnetic permeability of the steel sheet in the rolling direction to an anhysteretic magnetic permeability of the steel sheet in a transversal direction being not higher than 0.5 or not lower than 2.0, and a higher value of the two anhysteretic magnetic permeability values in the rolling direction and in the transversal direction being not lower than 18000; and the direction, in which the anhysteretic magnetic permeability of the steel sheet is said higher value, corresponds to the horizontal plane direction of said long side member and to the horizontal plane direction of said short side member.

3. An inner magnetic shield excellent in a shielding effect from geomagnetism used in a color cathode ray tube, the inner magnetic shield having a substantially truncated pyramidal body which has a pair of short side members of a screen and a pair of long side members of a screen, and constructed such that said short side members are joined to said long side members at edge portions of the substantially truncated pyramidal magnetic shield, wherein:

the inner magnetic shield is made of a steel sheet, a ratio of an anhysteretic magnetic permeability of the steel sheet in a rolling direction to an anhysteretic magnetic permeability of the steel sheet in a transversal direction being not higher than 0.5 or not lower than 2.0, and a higher value of the two anhysteretic magnetic permeability values in the rolling direction and in the transversal direction being not lower than 18000; and the direction, in which the anhysteretic magnetic permeability of the steel sheet is said higher value, corresponds to the horizontal plane direction of said short side member.

4. The inner magnetic shield according to claim 3, wherein said long side member and/or said short side member includes a V-shaped notch.

5. The inner magnetic shield according to claim 3, wherein said long side member and/or said short side member includes a slit.

6. The inner magnetic shield according to claim 4, wherein said long side member and/or said short side member includes a slit.

7. An inner magnetic shield excellent in the shielding effect from geomagnetism used in a color cathode ray tube, the inner magnetic shield having a substantially truncated pyramidal body which has a pair of short side members of a screen and a pair of long side members of a screen, and constructed such that said short side members are joined to said long side members at edge portions of the substantially truncated pyramidal magnetic shield, wherein:

the inner magnetic shield is made of a steel sheet, a ratio of an anhysteretic magnetic permeability of the steel sheet in a rolling direction to an anhysteretic magnetic permeability of the steel sheet in a transversal direction being not higher than 0.7 or not lower than 1.4, and a higher value of the two anhysteretic magnetic permeability values in the rolling direction and in the transversal direction being not lower than 18000, or a ratio of an anhysteretic magnetic permeability of the steel sheet in a rolling direction to an anhysteretic magnetic permeability of the steel sheet in a transversal direction being not higher than 0.5 or not lower than 2.0, and a higher value of the two anhysteretic magnetic permeability values in the rolling direction and in the transversal direction being not lower than 18000; and the direction, in which the anhysteretic magnetic permeability of the steel sheet is said higher value, corresponds to the horizontal plane direction of said short side member and to the horizontal plane direction of said long side member.

8. The inner magnetic shield according to claim 7, wherein said long side member and/or said short side member includes a V-shaped notch.

9. The inner magnetic shield according to claim 7, wherein said long side member and/or said short side member includes a slit.

10. The inner magnetic shield according to claim 8, wherein said long side member and/or said short side member includes a slit.

11. A steel sheet for inner magnetic shields excellent in a shielding effect from geomagnetism, wherein a ratio of an anhysteretic magnetic permeability of the steel sheet in a rolling direction to an anhysteretic magnetic permeability of the steel sheet in a transversal direction is not higher than 0.7 or not lower than 1.4, and a higher value of the two anhysteretic magnetic permeability values in the rolling direction and in the transversal direction is not lower than 18000.

12. The steel sheet according to claim 11, wherein the steel sheet consists essentially of higher than 0.005% and not higher than 0.06% by weight of C, lower than 0.3% by weight of Si, not higher than 1.5% by weight of Mn, not higher than 0.05% by weight of P, not higher than 0.04% by weight of S, not higher than 0.1% by weight of Sol. Al, and the balance of Fe.

13. A steel sheet for inner magnetic shields excellent in a shielding effect from geomagnetism, wherein a ratio of an anhysteretic magnetic permeability of the steel sheet in a rolling direction to an anhysteretic magnetic permeability of the steel sheet in a transversal direction is not higher than 0.5 or not lower than 2.0, and a higher value of the two anhysteretic magnetic permeability values in the rolling direction and in the transversal direction is not lower than 18000.

14. The steel sheet according to claim 13, wherein the steel sheet consists essentially of higher than 0.005% and not higher than 0.06% by weight of C, lower than 0.3% by weight of Si, not higher than 1.5% by weight of Mn, not higher than 0.05% by weight of P, not higher than 0.04% by weight of S, not higher than 0.1% by weight of Sol. Al, and the balance of Fe.

15. A method of manufacturing a steel sheet for inner magnetic shields excellent in a shielding effect from geomagnetism, comprising the steps of:

hot rolling a steel slab consisting essentially of higher than 0.005% and not higher than 0.06% by weight of C, lower than 0.3% by weight of Si, not higher than 1.5% by weight of Mn, not higher than 0.05% by weight of P, not higher than 0.04% by weight of S, not higher than 0.1% by weight of Sol. Al, and the balance of Fe;

cold rolling the resultant hot rolled steel band;

continuously annealing the resultant cold rolled steel band at temperatures of 600° C. to 780° C. under a line tension not lower than 9.8 $N/mm^2$; and tempering rolling the annealed steel sheet as required at an elongation rate not higher than 0.2%.

* * * * *